US011614714B2

(12) United States Patent
Grand et al.

(10) Patent No.: US 11,614,714 B2
(45) Date of Patent: Mar. 28, 2023

(54) DEVICE FOR FIXING A WRISTBAND TO A WATCH CASE

(71) Applicant: ROLEX SA, Geneva (CH)

(72) Inventors: Fabien Grand, Saint-Julien-en-Genevois (FR); Flavien Kressmann, Village Neuf (FR); Jean-Baptiste Robin, Annemasse (FR)

(73) Assignee: ROLEX SA, Geneva (CH)

( * ) Notice: Subject to any disclaimer, the term of this patent is extended or adjusted under 35 U.S.C. 154(b) by 944 days.

(21) Appl. No.: 16/388,982

(22) Filed: Apr. 19, 2019

(65) Prior Publication Data

US 2019/0332062 A1 Oct. 31, 2019

(30) Foreign Application Priority Data

Apr. 26, 2018 (EP) ..... 18169620

(51) Int. Cl.
*G04B 37/14* (2006.01)

(52) U.S. Cl.
CPC ..... *G04B 37/1486* (2013.01)

(58) Field of Classification Search
CPC ..... G04B 37/1486; Y10T 24/4782; Y10T 24/45602; A44C 5/14
USPC ..... 368/282
See application file for complete search history.

(56) References Cited

U.S. PATENT DOCUMENTS 4,432,655 A 2/1984 Wollman
8,770,831 B1 * 7/2014 Lalo ..... G04B 37/1486 368/282
2005/0265132 A1 * 12/2005 Ho ..... A44C 5/14 368/282
2006/0180000 A1 * 8/2006 Pernu ..... A44C 5/14 84/327
2006/0198248 A1 9/2006 Man
2015/0107300 A1 * 4/2015 Chan ..... A44C 5/107 63/4
2015/0164189 A1 * 6/2015 Wilson ..... A44C 5/14 224/164

(Continued)

FOREIGN PATENT DOCUMENTS

CN 1085329 A * 4/1994 ..... G04B 37/1486
CN 1317731 A * 10/2001 ..... A44C 5/14
DE 8136009 U1 4/1982

OTHER PUBLICATIONS

European Search Report and Written Opinion dated Oct. 15, 2018 issued in counterpart application No. EP18169620; w/ English machine translation (14 pages).

*Primary Examiner* — Edwin A. Leon
*Assistant Examiner* — Kevin Andrew Johnston
(74) *Attorney, Agent, or Firm* — WHDA, LLP

(57) ABSTRACT

A strand of a wristband (10) comprising an end intended for fixing removably to a watch case, wherein said strand comprises a projection (16) or a groove arranged at said end, said projection (16) or groove being intended to become lodged within a groove or projection of a watch case, and wherein said strand comprises at least one vertical opening (17) arranged in the thickness of said projection (16) or of a wall forming said groove and wherein said strand comprises an elastic element (30), so as to be able to accept a pin (20) through the elastic element (30) and through at least part of the length of said at least one vertical opening.

19 Claims, 3 Drawing Sheets

(56) References Cited

U.S. PATENT DOCUMENTS

| | | | | |
|---|---|---|---|---|
| 2017/0265607 | A1* | 9/2017 | Hatanaka | G04B 37/1486 |
| 2018/0157216 | A1* | 6/2018 | Vuille | G04B 37/1486 |

* cited by examiner

DEVICE FOR FIXING A WRISTBAND TO A WATCH CASE

This application claims priority of European patent application No. EP18169620.4 filed Apr. 26, 2018, the content of which is hereby incorporated by reference herein in its entirety.

INTRODUCTION

The present invention relates to a device for fixing a strand of a wristband to a watch case. The invention also relates to a strand of a wristband and to a wristband as such, which are designed to be fixed to a watch case using the fixing device according to the invention. Finally, the invention also relates to a watch case as such, designed for the fixing of a wristband using the fixing device according to the invention.

PRIOR ART

A traditional solution for attaching a wristband to a watch case is to use a spring bar arranged within a transverse opening formed at one end of a strand, and the two ends of which are shaped in such a way as to engage in housings made in the internal face of each of the lugs of the watch case. When a wristband is being fitted or removed using this traditional solution, the ends of the bar are designed to be retracted temporarily so that they can fit between the lugs of the wristband, and then, after being released, be introduced into the housings formed in each of the lugs. Such an operation may entail a significant assembly time and prove particularly tricky. This may notably have the consequence of marking the surface finish of the wristwatch, and more specifically, the underside of the lugs of the watch case.

The general objective of the invention is to offer a solution for fixing a wristband to a watch case that does not have all or some of the disadvantages of the prior art.

More specifically, a first object of the invention is to offer a solution for fixing a wristband to a watch case which makes the operations of securing and/or of detaching the wristband easier.

A second object of the invention is to offer a solution for fixing a wristband to a watch case that allows the wristband to be retained reliably and without play.

A third object of the invention is to offer a solution for fixing a wristband to a watch case that makes it possible to achieve a satisfactory aesthetic appearance at the connection between wristband and watch case.

A fourth object of the invention is to offer a solution for fixing a wristband to a watch case which does not comprise any risk of deterioration of the components when performing the fixing or the detaching, notably that avoids marking the watch case.

A fifth object of the invention is to offer a solution for fixing a wristband to a watch case the case middle of which has narrow lugs and/or a narrow lug width (width between lugs) or that has no lugs.

BRIEF DESCRIPTION OF THE INVENTION

To this end, the invention relies upon a strand of a wristband comprising an end intended for fixing removably to a watch case, wherein said strand comprises a projection or a groove arranged at said end, said projection or groove being intended to become lodged within a groove or projection of a watch case, and wherein said strand comprises at least one vertical opening arranged in the thickness of said projection or of a wall forming said groove and wherein said strand comprises an elastic element, so as to be able to accept a pin through the elastic element and through at least part of the length of said at least one vertical opening.

As an alternative, the invention relates to a watch case which comprises the female part corresponding to the male fixing part of the strand of a wristband described hereinabove. As an alternative, the male and female parts of the fixing device may be swapped between the strand of a wristband and the watch case. As a further alternative, the elastic element may be arranged at the male part or at the female part.

The invention also relates to a fixing device as such, to a wristband as such and to a timepiece as such.

The invention is more specifically defined by the claims.

BRIEF DESCRIPTION OF THE FIGURES

These objects, features and advantages of the invention will be set out in detail in the following description of one particular embodiment, which is given by way of nonlimiting illustration in connection with the attached figures among which.

To simplify the description which is to follow, the direction perpendicular to the plane of the watch case, oriented toward somebody looking at the watch, will be referred to as the vertical direction z. The adjective "lower" will therefore refer to that side of the watch case and of the wristband that is intended to come into contact with the wrist of a wearer. The direction extending from the center of a first lug 3 to the center of a second lug 3 opposite, perpendicular to the vertical direction, will be referred to as the transverse direction y. Finally, the direction oriented along the length of the wristband, perpendicular to the vertical and lateral directions, will be referred to as the longitudinal direction x.

Figure 1:
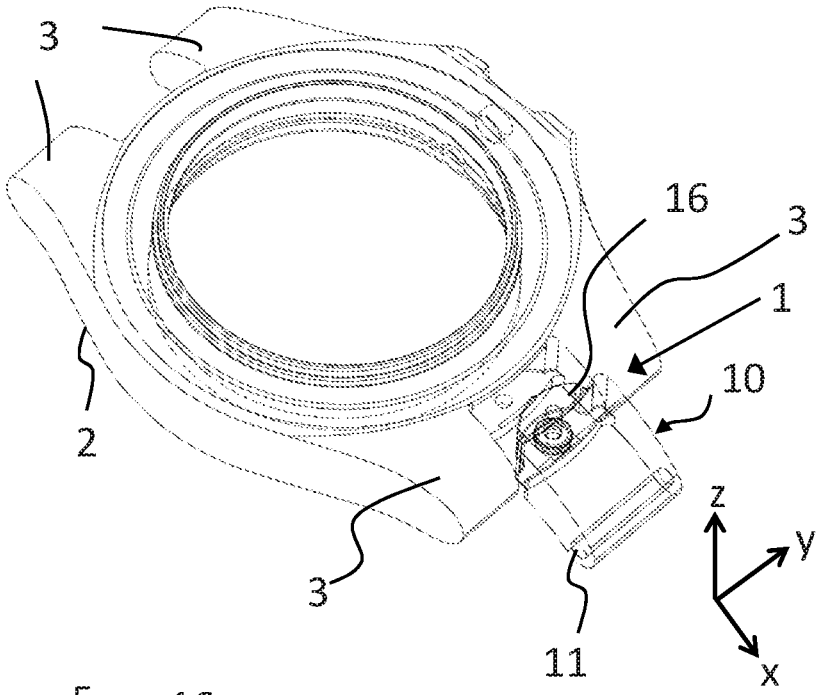
FIG. 1 depicts a perspective view, from above, of a device for fixing a wristband to a watch case according to one embodiment of the invention.

FIG. 1 depicts a watch case of which the case middle 2 comprises, on its periphery, two sets of two lugs 3 which are symmetrically and diametrically opposed, between which two strands of a wristband 10 can be fixed removably using a fixing device 1 according to one embodiment of the invention. For the sake of simplicity, this FIG. 1 depicts the end of just one strand of the wristband, more specifically an end link of a strand, it being possible for such a strand to be intended to be made up of assembled links.

This end link comprises a first end corresponding to the end of the strand, fixed to the watch case, and a second end comprising a receiving device 11 for another link of the strand of the wristband, in the form of a transverse opening intended to accept a connecting pin. Naturally, the fixing device 1 according to the embodiment of the invention is designed for fixing any other type of wristband or strand of a wristband other than a wristband made up of articulated links, such as a flexible wristband, for example made of leather or of composite material. Furthermore, two strands of a wristband will preferably be fixed respectively between each set of two lugs 3 of the watch case middle 2 respectively, using the one same fixing device 1, then fixed together at their other end by a clasp.

Figure 2:
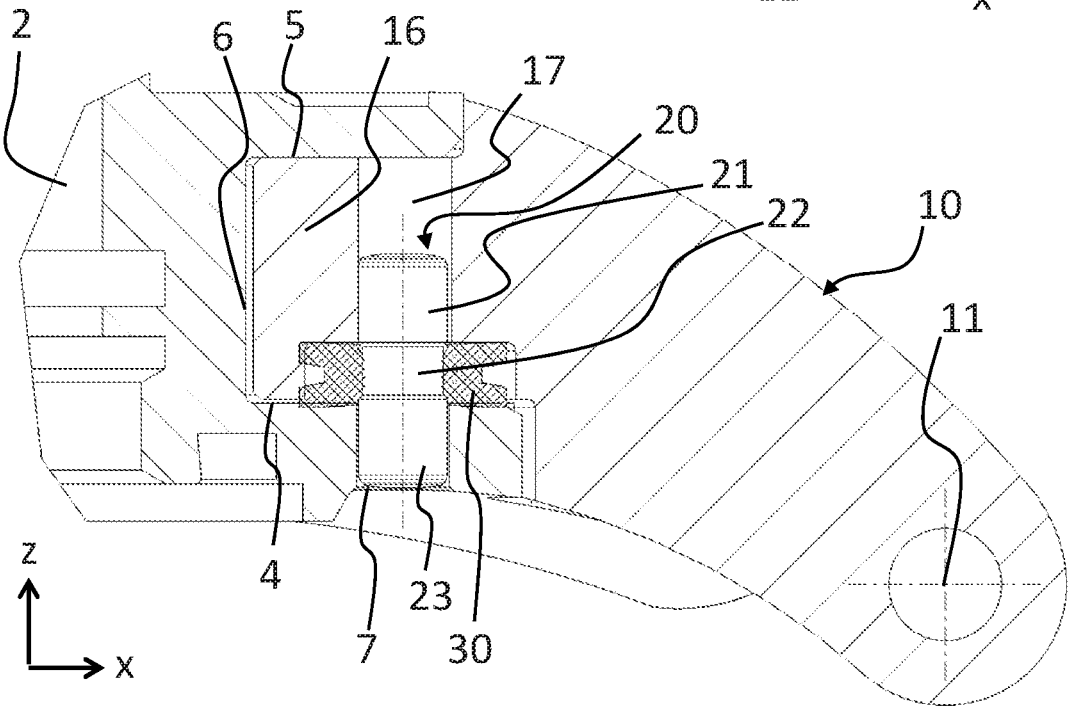
FIG. 2 depicts a view in section on a median longitudinal perpendicular plane of the device for fixing a wristband to a watch case according to the embodiment of the invention.

The fixing device 1 for a strand of the wristband 10 according to the embodiment of the invention is more specifically depicted in FIG. 2, in the configuration in which the wristband 10 is fixed. This fixing device 1 first of all relies on a special geometry in the region of the space between the lugs of the case middle 2 and which collaborates with a corresponding special geometry arranged at the end of the strand of the wristband 10.

The space between the lugs in effect comprises a component of which the cross section is, for example, shaped or substantially shaped as a U facing toward the wristband, thus defining a transverse groove. This groove extends transversely from the first lug 3 to the second lug 3 (measured along the transverse axis y) and is delimited by a lower surface 4, an upper surface 5, and a vertical surface 6 connecting these two, upper and lower, surfaces at the case middle 2. The lower surface 4 comprises a through-bore 7 (or opening 7), oriented vertically, positioned substantially at the center of the space between the lugs when considering the transverse direction.

Figure 3:
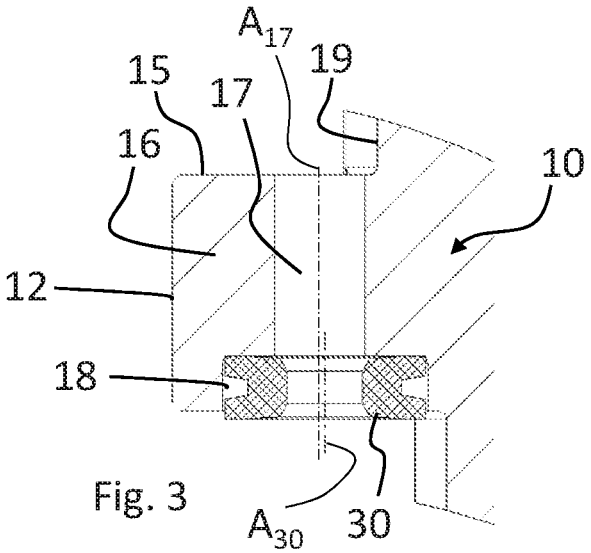
FIG. 3 depicts a view in section on a median longitudinal perpendicular plane of the end of the wristband which end is intended to collaborate with a watch case via a fixing device according to the embodiment of the invention.

The wristband 10 comprises a projection 16 at its end, depicted more specifically in FIG. 3, intended for a housing within the groove arranged in the space between the lugs of the case middle. This projection 16 comprises a through bore 17 (or opening 17), oriented vertically, positioned substantially in the center of the projection when considering the transverse direction. This construction is designed so that the two bores 7, 17 are substantially aligned when the projection 16 of the wristband 10 is housed in the groove of the space between the lugs. The wristband 10 additionally comprises a housing 18 on the lower surface of the projection 16, intended to accept an elastic element 30, removably. Such an elastic element 30 thus extends substantially in a plane parallel to the plane of the strand of the wristband, and comprises a through opening which may be offset, notably offset by an amount preferably of between 0.02 mm and 0.5 mm, from the bore 17 of the projection, as will be detailed hereinafter.

The fixing device 1 for fixing the strand of the wristband 10 to the watch case additionally comprises a pin 20, of which a lower portion 23 is housed in the bore 7 of the case middle 2, an intermediate portion 22 is housed in the bore of the elastic element 30, and an upper portion 21 is housed in the bore 17 of the projection 16 of the wristband 10. This pin 20, in conjunction with the elastic element 30, provides reliable and play-free retention of the wristband 10 on the watch case.

The way in which the wristband fixing device according to the embodiment works will now be detailed with reference to FIGS. 4 and 5.

In a prior phase, an elastic element 30 is positioned in the housing 18 provided at the end of the wristband, mentioned previously. According to the embodiment, the elastic element 30 comprises a substantially annular shape and the housing 18 has a circular cross section of which the diameter may be slightly smaller than the diameter of the elastic element, so as to allow the elastic element to be held in said housing by its being slightly compressed. Next, the end of the wristband is positioned in the space between the lugs of the watch case, so that the projection 16 of the wristband positions itself in the groove arranged between the lugs. One observation: the height of this projection 16 corresponds substantially to the distance between the two, lower 4 and upper 5, surfaces that delimit the groove in the heightwise direction, with a small amount of clearance to facilitate the insertion of the projection without encountering resistance. Likewise, the depth of the groove corresponds substantially to the length of the projection 16, measured in the longitudinal direction, with a small amount of clearance to make sure that this projection is not blocked by its vertical surface 12 coming into abutment at its end early.

Figure 4:
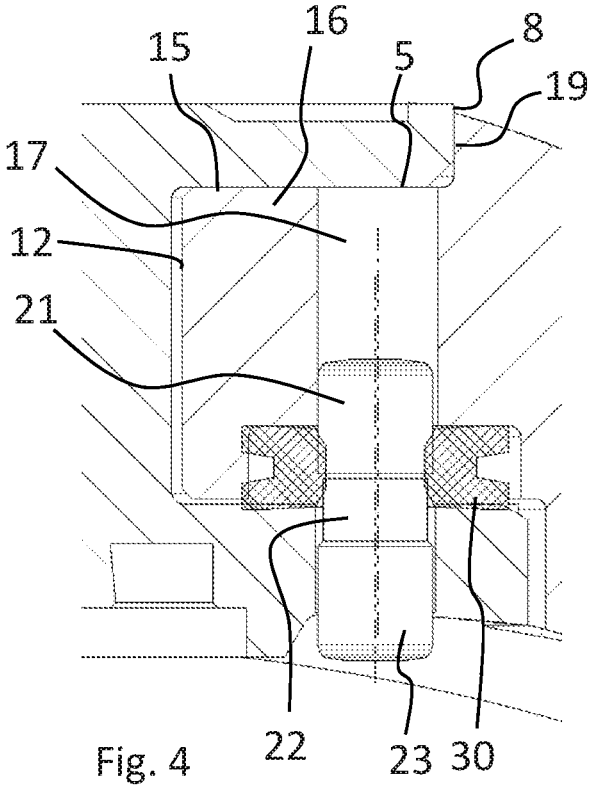
FIG. 4 depicts a view in section on a median longitudinal perpendicular plane of the fixing device according to the embodiment of the invention, in a phase of securing a wristband.
Figure 5:
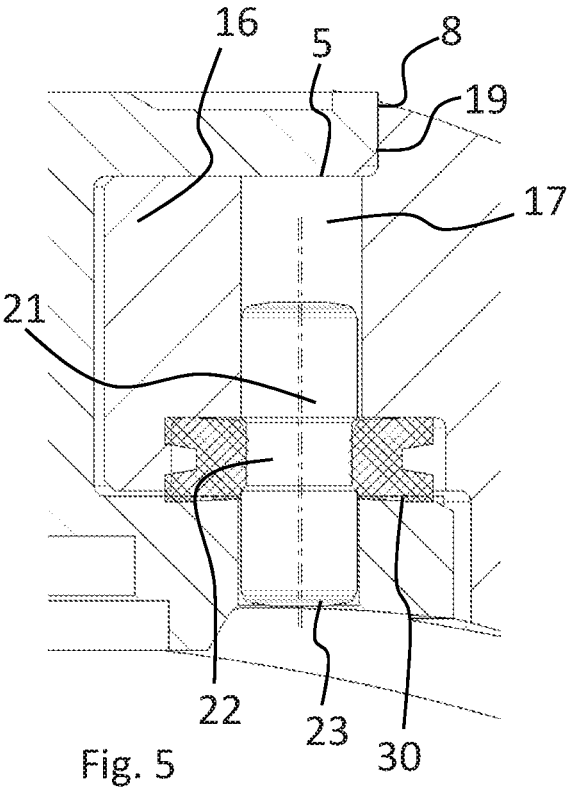
FIG. 5 depicts a view in section on a median longitudinal perpendicular plane of the fixing device according to the embodiment of the invention in a fixed configuration.

Next, as depicted in FIG. 4 which shows a transient phase in the vertical insertion of the pin, the pin 20 is inserted via the bore 7 of the case middle 2. The upper portion 21 of the pin has a diameter greater than that of its intermediate section 22. This upper portion 21 of the pin likewise has a diameter greater than that of the bore of the elastic element 30. The pin 20 is thus driven through the elastic element: naturally, the abovementioned diameters and elastic properties of the elastic element are chosen to allow the pin to be inserted with suitable force and without damaging the elastic element, while at the same time guaranteeing correct retention of the pin and of the wristband at the end of this insertion. This insertion continues until the pin 20 reaches its final position depicted in FIGS. 2 and 5 in which its smaller-diameter intermediate portion 22 of the pin 20 is positioned inside the bore of the elastic element 30.

When the pin 20 is in its final position, it would appear that it is axially blocked by the elastic element 30, making it possible to form a reliable and stable connection of the pin. This results in reliable fixing of the wristband. Furthermore, the elastic element 30, because of its elastic property, compensates for any play and allows the wristband 10 to be fixed without play to the watch case. The insertion of the pin 20 has the effect of pressing the upper surface 15 of the projection 16 against the upper surface 5 of the groove, ensuring that the wristband is blocked in position without play in the vertical direction.

According to the embodiment of the invention, there is an offset between the housing 18 and the bore 17 of the wristband 10. There is also an offset between the housing 18 of the wristband and the bore 7 of the watch case. More specifically, the axis $A_{17}$ of the bore 17 of the wristband 10 is arranged so that it is set back slightly in the longitudinal direction with respect to the axis of the housing 18 of the watch case, which defines the axis $A_{30}$ of the elastic element 30. Thus, the through-opening of the elastic element 30 is slightly offset from the bore 17 of the wristband 10, as is depicted more specifically in FIG. 3.

It is possible to position the pin 20 through the two bores 7 and 17 by deforming, notably compressing, the elastic element 30, this compensating for the abovementioned offset. This results in a particular load being applied to the wristband, oriented in the longitudinal direction toward the watch case, and which has a tendency to press a vertical upper surface 19 of the wristband firmly against a vertical surface 8 at the end of the upper surface 5 of the slot in-between the lugs. This embodiment encourages play-free retention of the wristband in the longitudinal direction. It also makes it possible to ensure continuity between the upper surfaces of the watch case and the upper surface of the wristband, at the interface between these, this guaranteeing a good esthetic perception.

Figure 6:
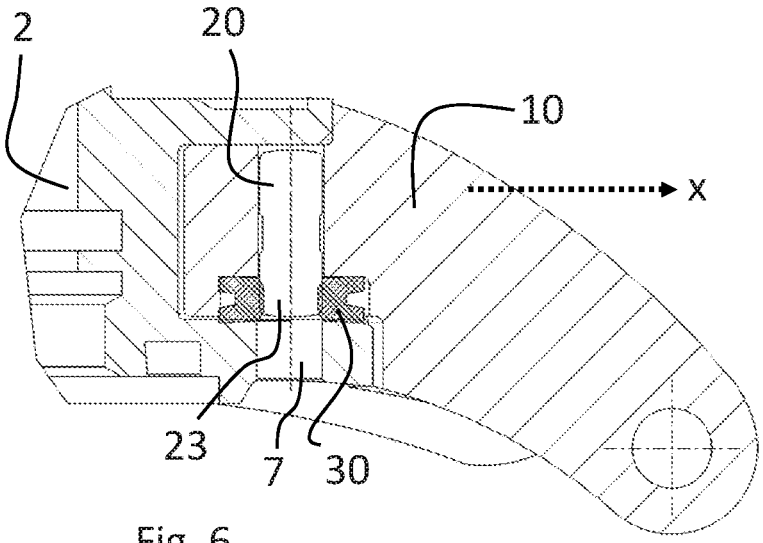
FIG. 6 depicts a view in section on a median longitudinal perpendicular plane of the fixing device according to the embodiment of the invention in a phase of detaching a wristband.
Figure 7:
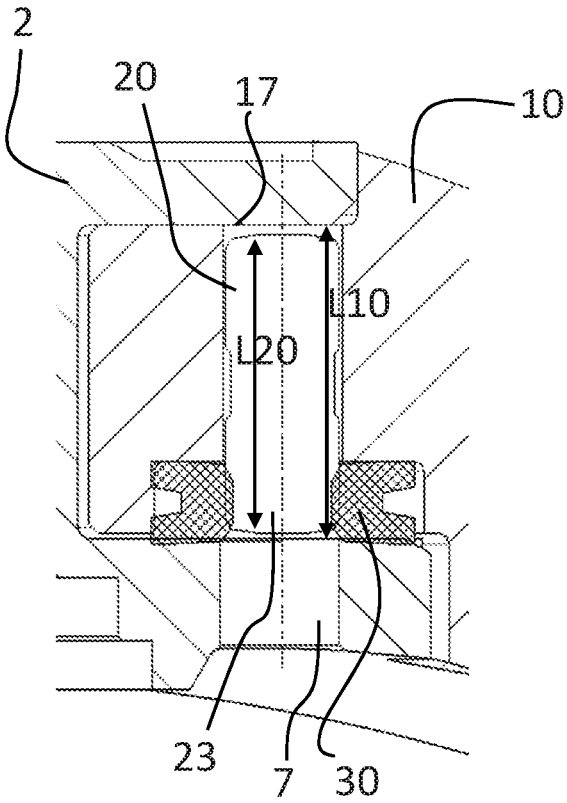
FIG. 7 depicts an enlarged view in section of details of FIG. 6.
Figure 8:
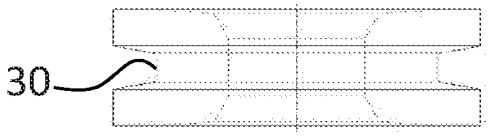
FIGS. 8 to 12 depict side views of various alternative forms of elastic elements that can be used in the fixing device according to the embodiment of the invention.

FIGS. 6 and 7 illustrate a phase of detaching a wristband. To do that, the pin 20 is driven through the elastic element, in the same direction as in the securing phase described hereinabove. During this operation, the lower portion 23 of the pin, of a diameter substantially equal to that of the upper portion 21, becomes lodged within the elastic element 30. The operation is continued to the point at which the pin 20 has completely left the bore 7 between the lugs of the case middle, in the position depicted in FIGS. 6 and 7. As a remark, in order to allow this operation, the length L10 of the bore 17 of the wristband 10 is at least equal to the length L20 of the pin 20. Thus, the bore 17 may as an alternative be a blind bore, so long as the above requisite is met. In the position of FIGS. 6 and 7 it can be seen that the pin is no longer blocking the wristband 10 which can be removed by a simple tug in the longitudinal direction x. The pin 20 can then be recovered or replaced ready for a subsequent securing operation.

Figure 9:
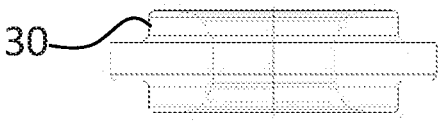
Figure 10:
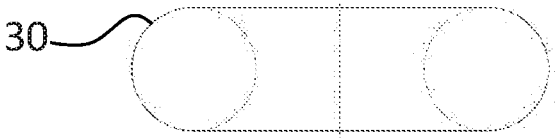
Figure 11:
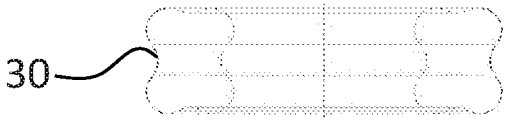
Figure 12:
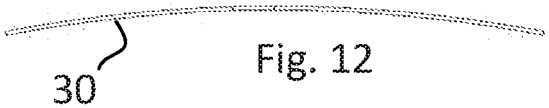

The elastic element 30 takes the form of a ring or of a snap ring. It may be a polymer seal or an elastomer seal. Its cross section may be U-shaped, as partially depicted in FIG. 8 and FIGS. 2 to 7, or T-shaped as depicted in FIG. 9. As an alternative, the elastic element 30 may be an O-ring, as depicted in FIG. 10, or even a sealing ring with four lobes as depicted in FIG. 11. According to yet another alternative form, it is also conceivable to use a spring washer, notably a metal foil, as depicted in FIG. 12. Furthermore, the elastic element may as an alternative adopt any other form. Naturally, the invention is not confined to the embodiment described. Thus, the case middle or even the watch case, may have any other shape able to accept a wristband and retain it using a vertical pin. For example, the bore 7 in the case middle may as an alternative be a bore of the upper surface 5 of the groove and the wristband would then comprise an elastic element arranged at its upper surface. The case middle does not necessarily have lugs, it being possible for a groove to be arranged independently of the lugs. In addition, the wristband could comprise a projection of a different geometry. The bore 17 of the wristband may open onto one or other of the faces of the projection of the strand of the bracelet, without necessarily being a through-bore. The elastic element could be arranged differently to correspond with the bore of the wristband.

Furthermore, the pin may have a maximum diameter less than or equal to 1.5 mm. This diameter is preferably comprised between 0.8 and 1.4 mm inclusive. As an alternative, the pin may have some other geometry, for example a cross section of non-circular shape. As an alternative, it could have a simplified geometry with a cross section that is constant over its entire length, intended to allow operations of securing and detaching via the elastic element while at the same time ensuring good retention of the assembly. Finally, the embodiment makes it possible to achieve a satisfactory result using one single pin. As an alternative, two pins or more could be used for fixing the one same strand of a wristband.

Finally, the connection described hereinabove may naturally be reversed, the projection being arranged on the case middle, notably between lugs, so as to collaborate with a groove arranged at the end of a strand of a wristband. Furthermore, in both instances, the elastic element may be housed either in the component, be it wristband or watch case, that comprises the projection, as depicted, or in the other component that comprises the groove. Finally, the connection between watch case and a strand of a wristband has been described with a single projection, forming a male part, collaborating with a single groove, forming a female part; as an alternative, there could be several projections collaborating with several grooves, fixed by one or several pins. Thus, the invention applies to an implementation comprising at least one projection and at least one groove.

The invention claimed is:

1. A strand of a wristband comprising:

an end intended for fixing removably to a watch case, a projection or a groove arranged at the end, the projection or groove being intended to become lodged within a groove or projection of a watch case, at least one vertical opening arranged in a thickness of the projection of the strand of the wristband or of a wall forming the groove of the strand of the wristband, and an elastic element positioned at least partially facing the at least one vertical opening, so as to be able to accept a pin through the elastic element and through at least part of a length of the at least one vertical opening, wherein the elastic element is housed removably in a housing arranged at a lower or upper surface of the strand, extending substantially in a plane parallel to a plane of the strand.

2. The strand as claimed in claim 1, wherein at least one selected from the group consisting of (i) the at least one vertical opening opens onto one of the faces of the projection or of the groove of the strand and (ii) the at least one vertical opening passes through a thickness of the projection or of the groove of the strand.

3. The strand as claimed in claim 1, wherein the elastic element is an element able to hold the strand on a watch case with minimal clearance using a pin, the elastic element being selected from the group consisting of a snap ring, a polymer seal having a U-shaped or T-shaped cross section, an O-ring, a four-lobed ring and a spring washer.

4. The strand as claimed in claim 3, wherein the elastic element comprises a through opening arranged around an axis of the elastic element, and wherein the axis of the elastic element is offset from an axis of the vertical opening.

5. The strand as claimed in claim 1, wherein the strand is a flexible strand.

6. A device for removably fixing the strand as claimed in claim 1 to a watch case, wherein the device comprises:

at least one groove parallel to a plane of a frame of the watch case arranged on a periphery of the watch case, delimited by an upper surface and a lower surface which are parallel to the plane of the frame of the watch case, the at least one groove being able to accept the projection positioned at the end of the strand;

at least one watch case opening passing vertically through one of the lower or upper surfaces delimiting the at least one groove of the watch case, so that the at least one opening is substantially aligned with the at least one vertical opening of the strand, when the strand is fixed;

at least one pin able to become lodged through the elastic element, arranged within the watch case or within the strand to correspond with the respective openings thereof, through a part of the at least one vertical opening of the strand and through the at least one watch case opening to guarantee the holding of the strand on the watch case.

7. The fixing device as claimed in claim 6, wherein a length of the at least one pin is less than or equal to a length of the at least one vertical opening of the strand.

8. The fixing device as claimed in claim 6, wherein the at least one pin comprises a smaller-diameter intermediate portion intended to be housed within the elastic element.

9. The fixing device as claimed in claim 6, wherein a height of the projection of the strand is substantially equal to a height of the groove of the watch case, so that a surface of the projection which is opposite to a surface that has the at least one pin inserted into it is pressed firmly against a surface delimiting the groove of the watch case, which is opposite to a surface delimiting the projection comprising the at least one vertical opening of the strand that accepts the at least one pin.

10. The fixing device as claimed in claim 6, wherein the at least one groove of the watch case is arranged on a case middle between two lugs.

11. A device for removably fixing the strand as claimed in claim 1 to a watch case, wherein the device comprises:

at least one projection parallel to a plane of a frame of the watch case arranged on a periphery of the watch case, delimited by an upper surface and a lower surface which are parallel to the plane of the frame of the watch case, the at least one projection being able to accept the groove positioned at the end of the strand;

at least one opening of the watch case passing vertically through the at least one projection of the watch case so that the at least one opening is substantially aligned with the at least one vertical opening arranged in a wall forming the groove of the strand when the strand is fixed;

at least one pin able to become lodged through the elastic element, arranged within the watch case or within the strand to correspond with the respective openings thereof, through the at least one vertical opening of the strand and through part of the at least one watch case opening, to guarantee the holding of the strand on the watch case.

12. A watch case intended for the removable fixing of at least one strand as claimed in claim 1, wherein the watch case comprises:

at least one groove parallel to a plane of a frame of the watch case arranged on a periphery of the watch case, delimited by an upper surface and a lower surface which are parallel to the plane of the frame of the watch case, the at least one groove being able to accept a projection positioned at the end of the strand; and at least one watch case opening passing vertically through one of the upper or lower surfaces delimiting the groove of the watch case, able to accept a pin for fixing the strand, and an elastic element arranged at least partially facing the at least one opening.

13. A wristband, wherein the wristband comprises one or two strands as claimed in claim 1.

14. A timepiece, wherein the timepiece comprises a watch case and a wristband fixed removably to the watch case by the fixing device as claimed in claim 6.

15. A timepiece, wherein the timepiece comprises a watch case and a wristband fixed removably to the watch case by the fixing device as claimed in claim 11.

16. The strand of a wristband as claimed in claim 5, wherein the strand comprises at least one link.

17. A device for removably fixing the strand as claimed in claim 6 to a watch case, wherein the at least one groove is arranged on the periphery of the middle of the watch case.

18. A device for removably fixing the strand as claimed in claim 11 to a watch case, wherein the at least one projection is arranged on the periphery of the middle of the watch case.

19. A watch case intended for the removable fixing of at least one strand as claimed in claim 1, wherein the watch case comprises:

a projection arranged on a periphery of a watch case, the projection being adapted to become lodged within the groove of the strand;

at least one vertical opening arranged in a thickness of the projection; and an elastic element positioned at least in part facing the at least one vertical opening, so as to be able to accept a pin through the elastic element, through at least part of a length of the watch case opening and through the at least one vertical opening.

* * * * *